US005916033A

United States Patent [19]

Doherty

[11] Patent Number: 5,916,033

[45] Date of Patent: Jun. 29, 1999

[54] GOLF BALL TEEING-UP DEVICE

[76] Inventor: William L. Doherty, 1918 Palatka Rd., Louisville, Ky. 40214

[21] Appl. No.: 08/998,491

[22] Filed: Dec. 26, 1997

[51] Int. Cl.[6] ..... A63B 57/00

[52] U.S. Cl. ..... 473/135

[58] Field of Search ..... 473/132, 133, 473/134, 135, 136, 137

[56] References Cited

U.S. PATENT DOCUMENTS

| | | | |
|---|---|---|---|
| 4,017,087 | 4/1977 | Bruno | 473/133 |
| 5,016,886 | 5/1991 | Gould | 473/135 |
| 5,133,557 | 7/1992 | Sugimoto | 473/133 |
| 5,145,176 | 9/1992 | Lipson | 473/135 |
| 5,282,629 | 2/1994 | Eckstein | 473/133 |
| 5,330,194 | 7/1994 | Copeland | 473/132 |
| 5,356,148 | 10/1994 | Elder, Jr. | 473/133 |
| 5,415,409 | 5/1995 | Hellmann | 473/133 |
| 5,603,664 | 2/1997 | Provost | 473/134 |
| 5,611,737 | 3/1997 | Rau et al. | 473/133 |
| 5,645,491 | 7/1997 | Brown | 473/133 |
| 5,662,526 | 9/1997 | Sutherlin | 473/135 |

*Primary Examiner*—Steven Wong

[57] ABSTRACT

Disclosed is a device for teeing up golf balls having a hopper, a cycle start button, and an adjustable rubber tee. The hopper is operatively connected to the teeing up device to supply golf balls through the gravity fed supply tube to the rubber tee. The teeing up device comprises an air cylinder for raising and lowering in a cylinder tube to receive golf balls one at a time.

9 Claims, 7 Drawing Sheets

CYLINDER AT FULL RETRACTION
(BALL ROLLS ONTO TEE)

CYLINDER AT MID EXTENSION

CYLINDER AT FULL EXTENSION
(BALL AT STRIKING POSITION)

FIGURE 3 4 & 5 LIFT STROKE ILLUSTRATION

GOLF BALL TEEING-UP DEVICE

BACKGROUND

1. Field of Invention

The present invention relates to a golf ball teeing-up device for teeing-up golf balls.

2. Description of Prior Art

Many teeing-up apparatuses have been devised throughout the years; however, research has shown that so far very few have been placed on the market.

This device is an excellent training aid since repetition plays a significant part in learning the art of driving a golf ball. This repetition is improved by concentrating on the swing and upper body control since the operator never moves their feet, never takes their hands off the club and never bends over. The ball hopper and the switch is designed for use by either left or right handed operators. This design having an extreme low profile and narrow surface provides the golfer to exercise and to learn upper body control. For this reason, I have developed the ultimate tee-up device.

Some of the previous apparatuses have many mechanical moving pails and many are electrically operated. If these apparatuses are faulty or become wet, the operator may be harmed or receive electrical shock. The many moving parts also require regular maintenance. If regular maintenance is not performed, premature failure may occur due to lack of lubrication or adjustment. One example of such a device is by Hellmann, Bill W., U.S. Pat. No. 5415409.

Other known apparatus such as the vacuum operated device by Bobby J. Gould, U.S. Pat. No. 5016886 is short lived because a tight seal is required between the golf ball and the rubber tee. After striking several times, especially with irons, the rubber tee tends to get cut thereby preventing a tight seal.

In addition to many moving parts, possibility of electrical shock and premature failure due to loss of vacuum, there is ground water. Water will always find its way inside a hole in the ground and must either be carried away or prevented from entering the golf ball teeing-up device. My invention has a wiper blade designed to prevent moisture from entering the air cylinder when no pressure exists below the typical air cylinder seal. The Simplified mechanism for automatically teeing practice golf balls by John F. Elder, Jr., U.S. Pat. No. 5356148 is also short lived since it does not wipe the air cylinder shaft of moisture to prevent failure when water is allowed into the air valve system. The second and most obvious problem with John Elder's mechanism is that only the proprietor or driving range operator can adjust the ball height with special tools whereas my invention requires no tools and is adjustable by the golfer. Additional advantages of my invention is total control over the cycle and dwell time from air alone. The use of flow control valves gives my invention this ability whereas John F. Elders' invention requires a switching mechanism connected to timers.

Objects and Advantages

Accordingly, several objects and advantages of my invention provides a simpler and more reliable golf ball teeing-up device.

The air operated switch with a momentary pause allows the gravity led golf balls to drop onto a rubber tee in an extremely smooth traveling manner from tee-up position to tee-up position. Since this product is most often installed below ground level, water is an extreme obstacle. Having only a single moving part and requiring no lubrication or scheduled maintenance, makes this device the ultimate golf ball teeing-up apparatus. Other inventions having many moving parts and/or electrically operated devices are impractical when installed below ground level because of moisture.

The vacuum style apparatuses are short lived since the end of the rubber tee deteriorates allowing air to seep by causing a slow death.

Further objects and advantages of my invention will become apparent from a consideration of the drawings and ensuing description.

REFERENCE NUMERALS IN DRAWINGS

FIG. 1

1 Base Plate (Ground Level)
2 Ball Hopper
3 Air Filter Regulator
4 Gravity Ball Supply Tube
5 Cycle Start Button
6 Control Valve System
7 Port
8 Port
9 Cylinder Tube
10 Lift Cylinder
11 Locating Disc
12 Anchoring Nut
13 Thrust Disc
14 Adjustable Sleeve
15 Vertical Slot
16 Artificial Turf
17 Rod Seal/Mounting Nut
18 Rubber Tee (tube)
19 Lift Cylinder Shaft
20 Anti-Rotation Key

FIG. 2

Figures 3, 4, 5:
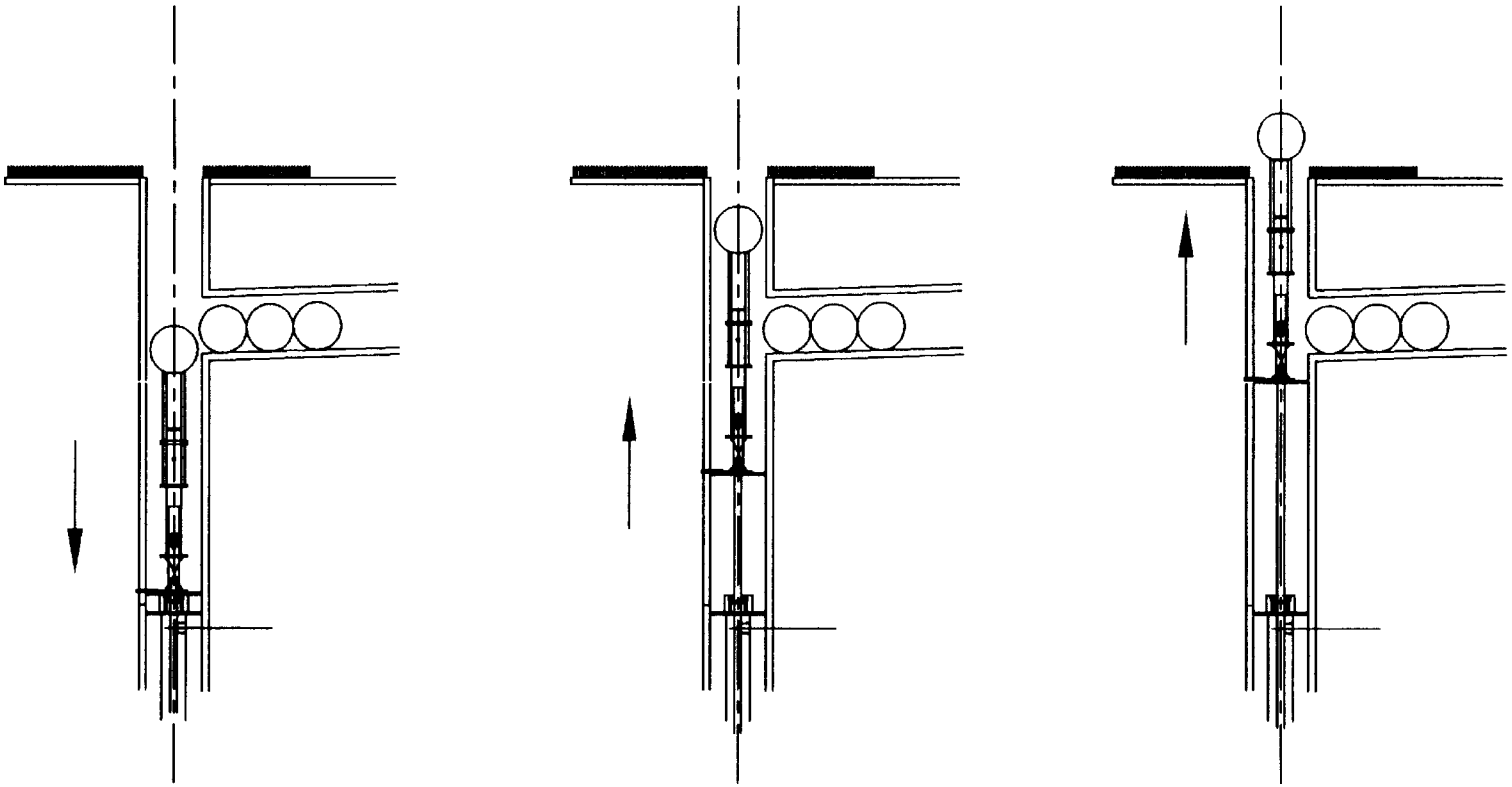
FIG. 3 illustrates the lift sequence of the device (cylinder at full retraction)
FIG. 4 illustrates the lift sequence of the device (cylinder at mid extension)
FIG. 5 illustrates the lift sequence of the device (cylinder at full extension)

14 Adjustable Sleeve
18 Rubber Tee (tube)
19 Lift Cylinder Shaft
21 Keeper Pins
22 Bayonnet Slot
23 Spring
24 Adapter Shaft
25 Bayonnet Pin FIG. 3 4 & 5 - Lift Stroke Illustration

FIG. 6 7 & 8

3 Air Filter Regulator
5 Cycle Start Button
7 Port

-continued

Figure 9:
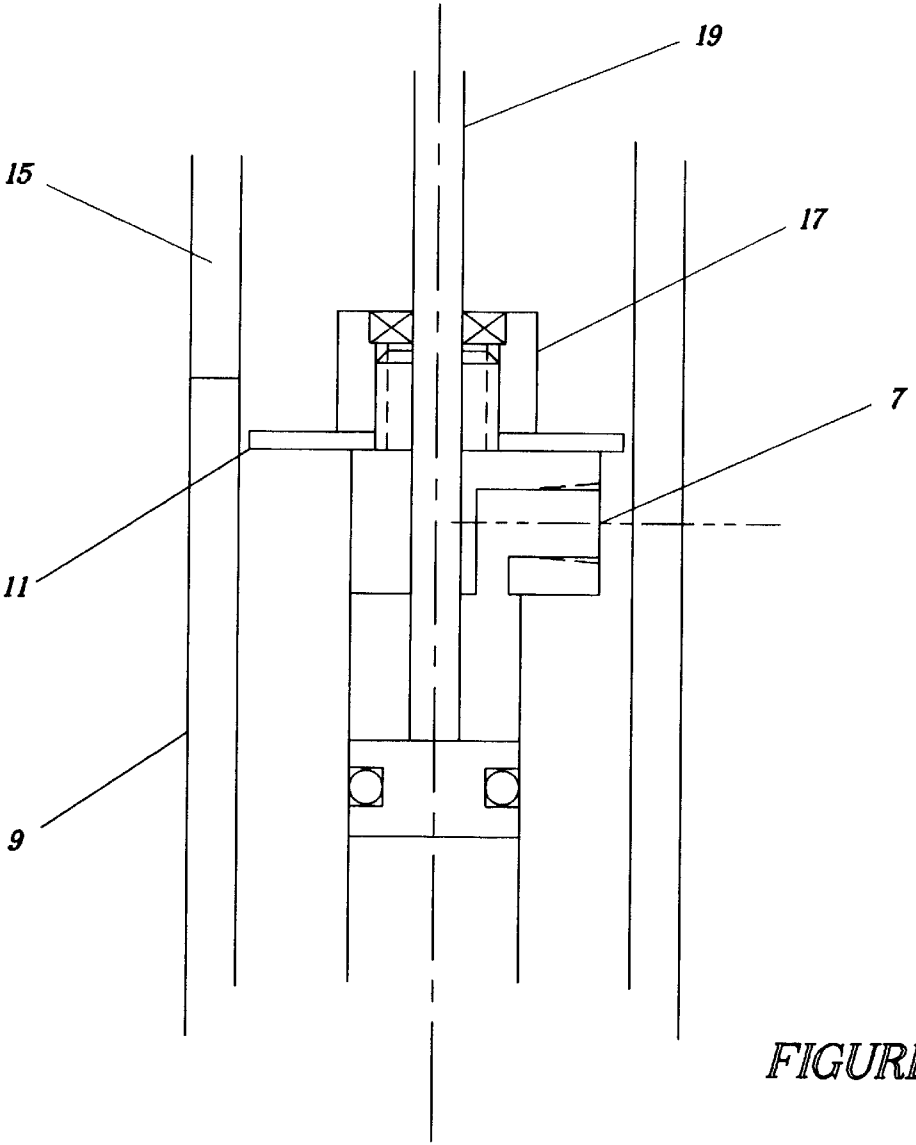
FIG. 9 illustrates the rod seal/mounting nut

8 Port
10 Lift Cylinder
19 Lift Cylinder Shaft
65 Director Block
66 Four way valve
67 Three way valve
68 Needle valve
69 Flow control valve
70 Flow control valve
FIG. 9

7 Port
9 Cylinder Tube
11 Locating Disc
15 Vertical Slot
17 Rod Seal/Mounting Nut
19 Lift Cylinder Shaft

SUMMARY OF THE INVENTION

The invention uses compressed air either from a compressor or a pressurized tank used solely for activating an air cylinder thus raising a golf ball from a predetermined point. This predetermined point is low enough to provide the minimum incline to allow the ball once fed into the supply tube via the ball hopper to become gravity fed enabling the ball to drop onto the tee. This provides a continuous gravity feed of all balls previously fed into a supply tube to be raised one at a time above the operating surface. The ball, once in position on a rubber tee attached to the end of a rod protruding from an air cylinder, can be height adjusted to allow the operator to simulate a fairway lie or a tee off lie. The device is activated by using the club sole to tap a control switch which initiates the automatic cycle. This eliminates the need for the operator to bend over, move their feet, and take their hands off the club thus improving golf skills by eliminating lower body movements.

DESCRIPTION OF THE PREFERRED EMBODIMENTS

Referring to the drawings of the golf practice device, hereinafter is referred to as golf ball teeing up device FIG. 1.

A rectangular base plate (1) lying horizontally at ground level is used to anchor the artificial turf (16) and the ball hopper (2). The cycle start button (5), the control valve system (6), the gravity ball supply tube (4), and the cylinder tube (9) are connected to the bottom of the rectangular base plate (1). The cylinder tube (9) holds the lift cylinder (10) vertically in position. The locating disc (11) keeps the lift cylinder (10) held in position (centered). The anchoring nut (12) holds the lift cylinder (10) against the bottom of the lift cylinder tube (9). The rod seal/mounting nut (17) holds the locating disc (11) in place. Attached to the lift cylinder shaft (19) is a thrust disc (13) with an anti-rotation key (20) mounted opposite the gravity ball supply tube (4) that rides in a vertical slot (15) located in the cylinder tube (9). This provides a means for adjusting the ball height by preventing the lift cylinder shaft (19) from rotating when turning the adjustable sleeve (14) from tee off lie to fairway lie height. Air is supplied by an air compressor or air tank thus providing a continuous flow of air pressure through the air filter regulator (3) to a control valve system (6). When the cycle start button (5) is momentarily pressed, air is directed to a pilot port (7) on the control valve system (6). This shifts the valve to allow air to pass through the port (7) of the lift cylinder (10) retracting it until the lift cylinder shaft (19) is fully retracted. Air pressure is held in the control valve system (6) allowing air pressure to pass through the port (8) keeping the lift cylinder shaft (19) extended when the control valve system (6) is at rest. The rubber tee (18) remains in the tee up position for adjusting the tee height if desired.

Operation—FIGS. 1, 2, 6, 7, 8, 9

Figure 1:
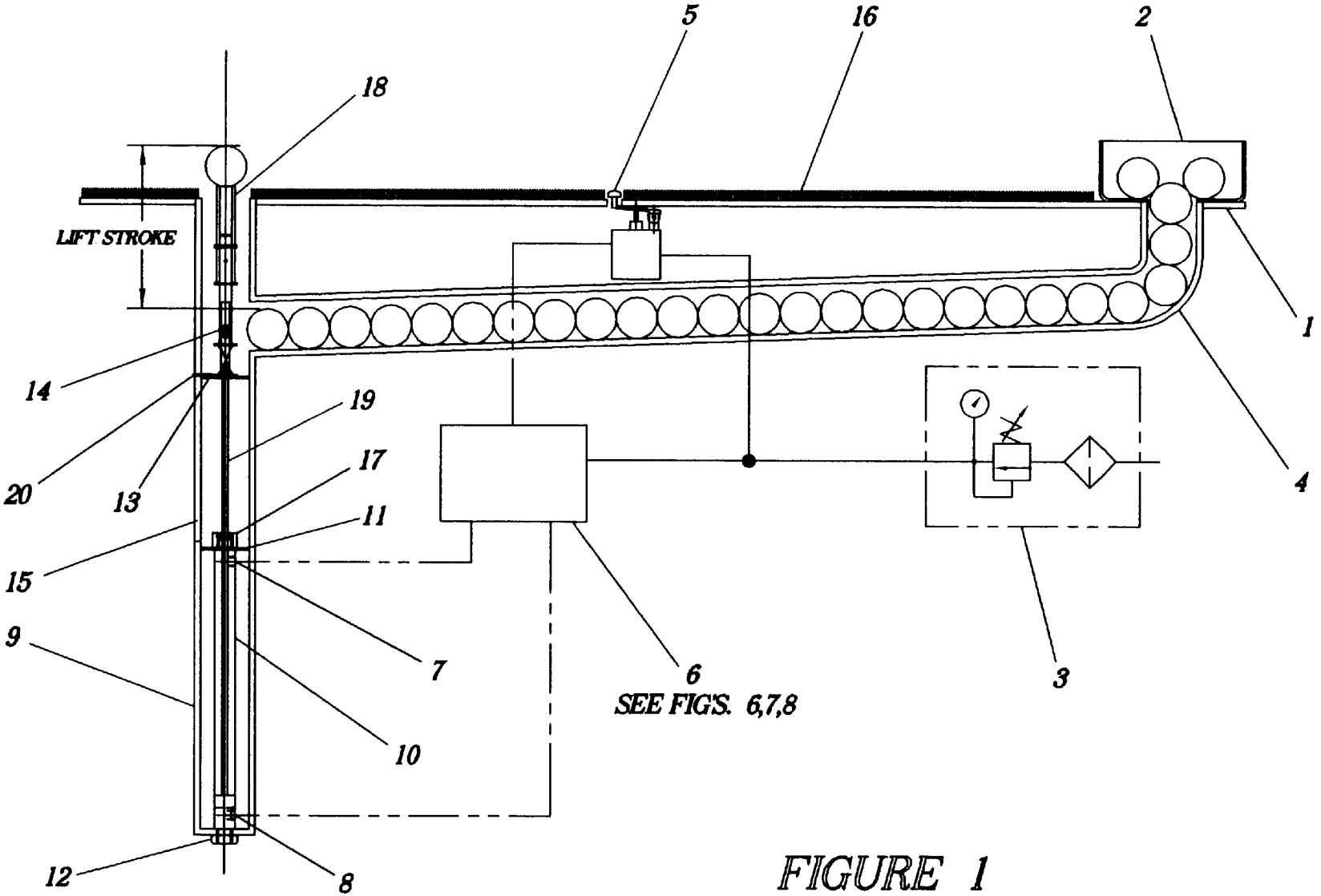
FIG. 1 is a vertical cross sectional view illustrating the device in a tee tip position.

A base plate (1) is shown in FIG. 1 which will have artificial turf (16) on the top surface. A ball hopper (2) is positioned near the end of base plate (1) so as to be clear of a left or right hand golfer driving golf balls. Golf balls placed in the ball hopper (2) drop into the slightly inclined gravity ball supply tube (4) providing the means for continuously feeding balls onto the rubber tee (18). Once the balls are loaded, the operator simply touches the cycle start button (5) with the sole of the golf club. This automatically activates the control valve system (6) which is totally air pressure operated having air supplied through air filter regulator (3) from a air compressor or pressurized tank, portable or otherwise. The control valve system (6) is normally at rest position Operation—FIGS. 1, 2, 6, 7, 8, 9 (continued) meaning that the rubber tee (18) is normally above the artificial turf (16). This allows the operator to adjust the height of the rubber tee (18). Fairway lie height is adjusted by pushing down and turning clockwise one-quarter turn against the adjustable sleeve (14). Tee off height is adjusted by pushing down and turning counter clockwise one-quarter turn against the adjustable sleeve (14).

Figure 2:
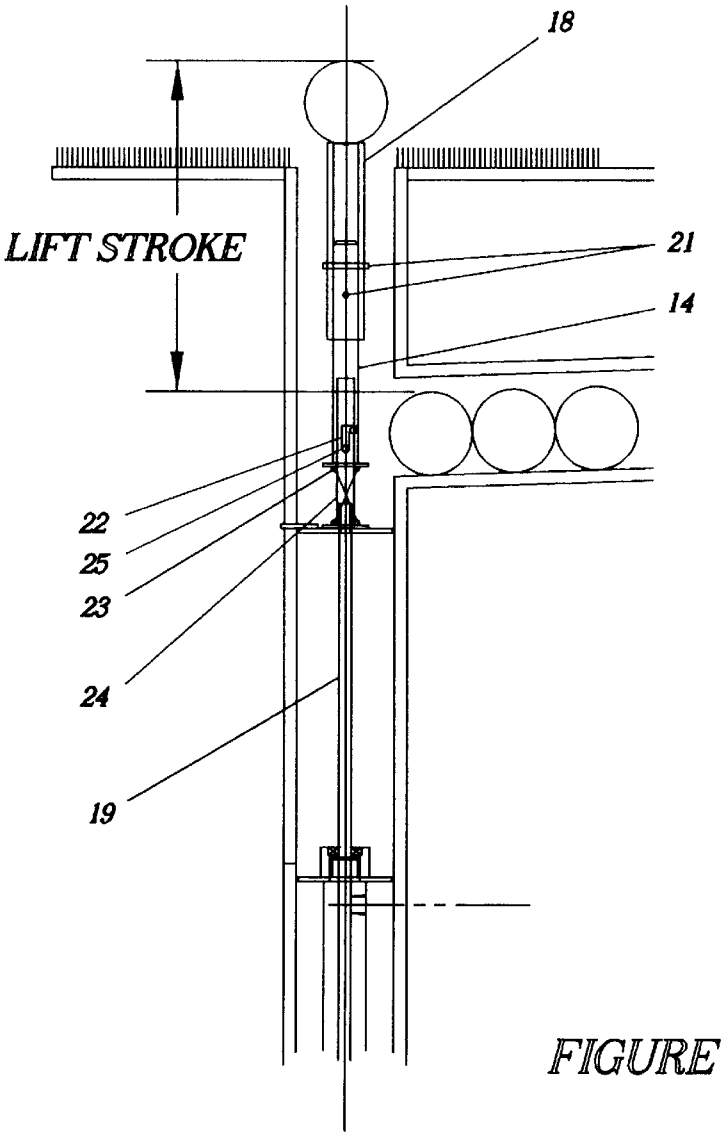
FIG. 2 is a vertical cross sectional view of the adjustable sleeve mechanism used to adjust ball height of the tee up device.

The adjustable sleeve mechanism (14) FIG. 2 slides over adapter shaft (24) that is attached to the lift cylinder shaft (19) allowing the operator to adjust the height of the rubber tee (18). Fairway lie height is adjusted by pushing down and turning clockwise one-quarter turn against the adjustable sleeve(14). Tee off height is adjusted by pushing down and turning counter clockwise one quarter turn against the adjustable sleeve (14). The ease of adjustment is accomplished by tension held against the adjustable sleeve (14) by the spring (23) allowing the bayonnet pin (25) pressed into the adapter shaft (24) protruding outward into the bayonnet slot (22) to ride and lock in the bottom of the bayonnet slot (22) for the tee off lie or at the top offset position of the bayonnet slot (22) for the fairway lie. The rubber tee (18) is held in position by two keeper pins (21) located at right angles to each other on the adjustable sleeve (14) to provide a means of holding the rubber tee (18) in position until replacement is necessary.

Figure 6:
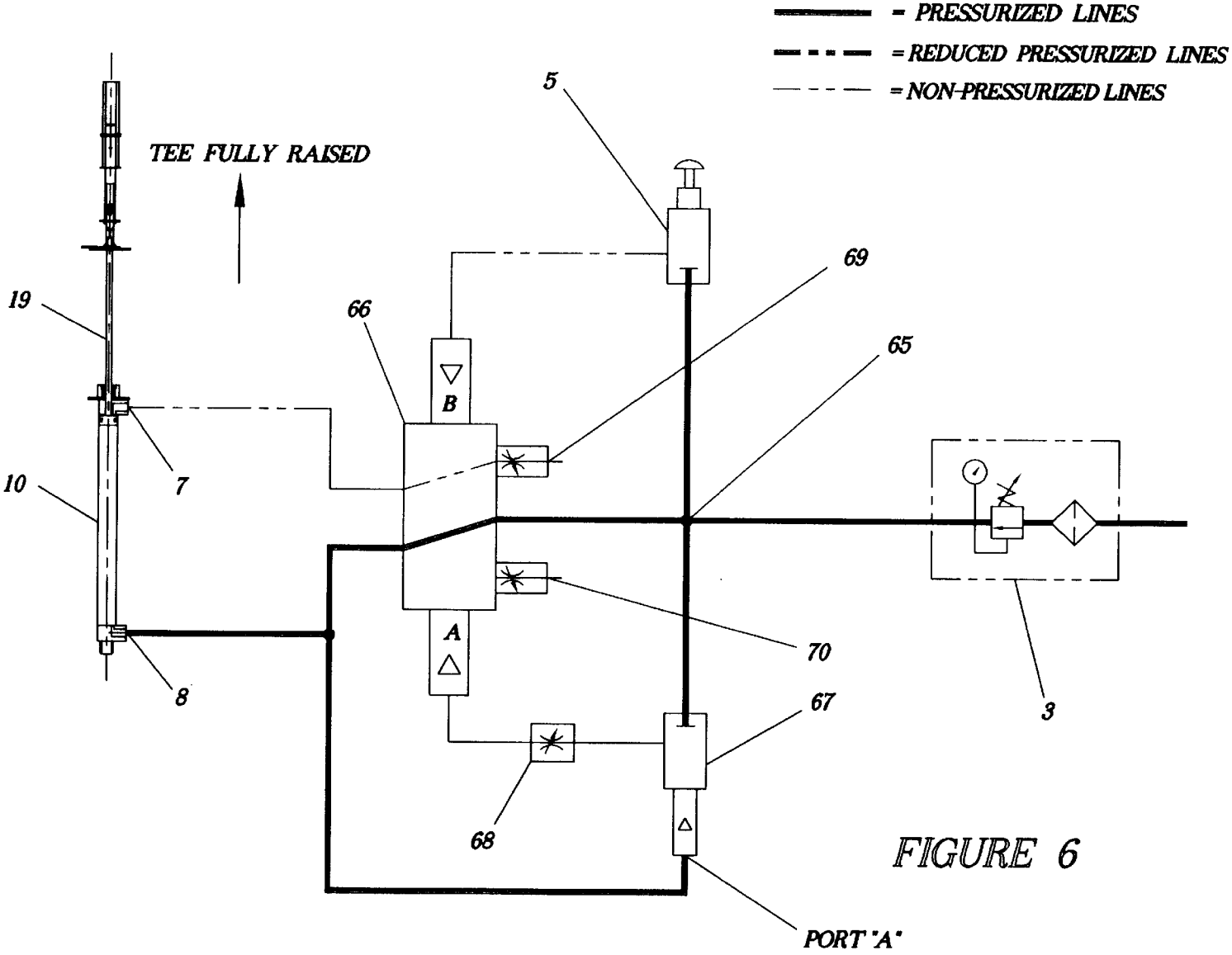
FIG. 6 illustrates air control valve system at rest—inactivated

The inactivated air control valve system (6) FIG. 6 allows air to pass through X fitting director block (65) into four way valve (66) to port(8) of lift cylinder (10) keeping it extended.

Figure 7:
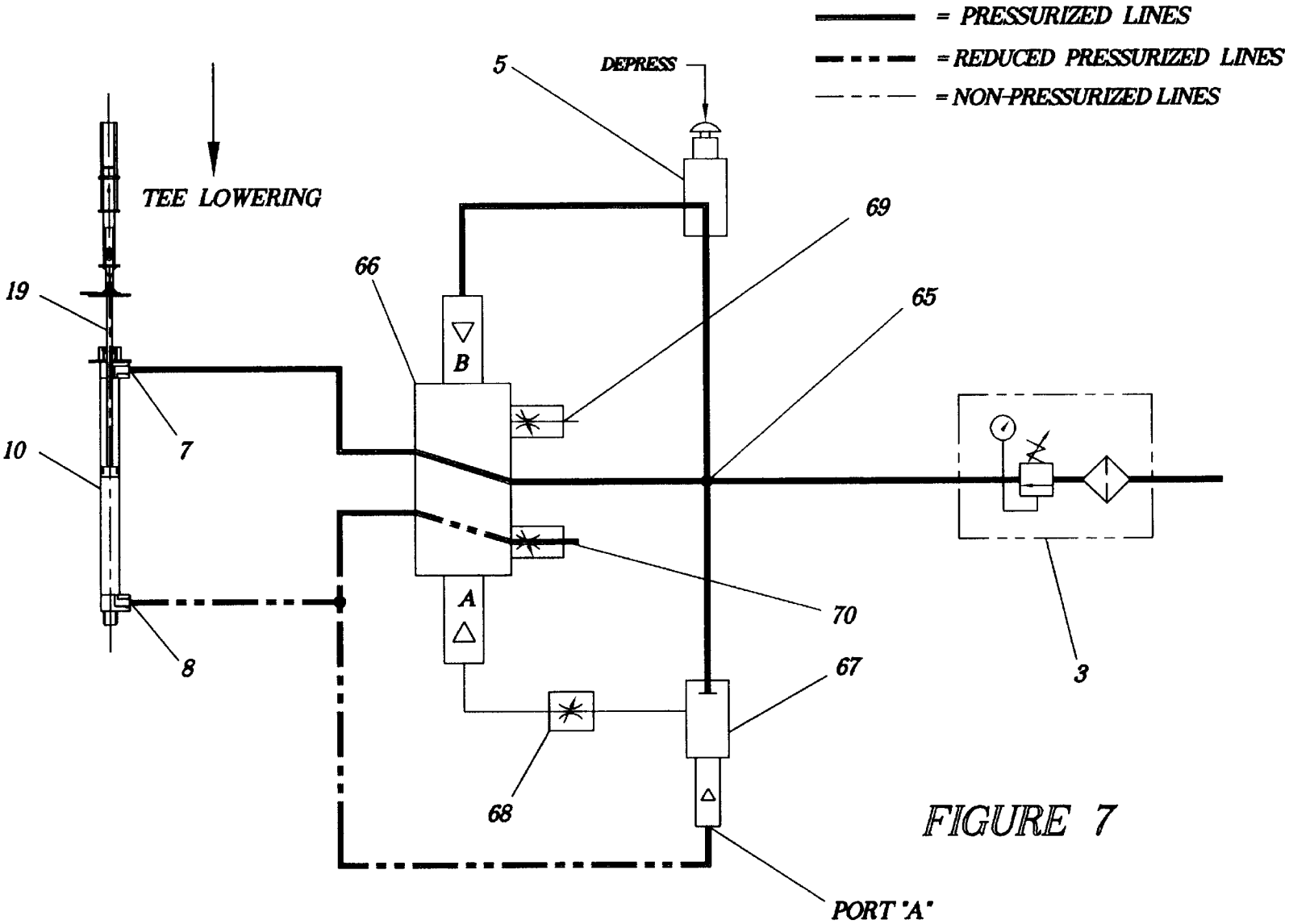
FIG. 7 illustrates air control valve system activated

The activated air control valve system (6) FIG. 7 is activated by pressing cycle start Operation—FIGS. 1, 2, 6, 7, 8, 9 (continued) button (5). Air is directed to pilot operator B on four way valve (66). This shifts the four way valve to allow air to pass to port (7) of the lift cylinder (10). During the inactivated condition and until the lift cylinder shaft (19) is fully retracted, air pressure is held on pilot port A of normally open three way valve (67). After lift cylinder shaft (19) fully retracts there is no pressure at pilot port A of normally open three way valve (67). The normally open three way valve (67) returns to its normal position allowing air to pass to pilot operator A of four way valve (66). This shifts four way valve (66) allowing air to pass to port (8) of lift cylinder (10) extending the lift cylinder shaft (19). The system is now ready for another cycle.

The key to the air logic system is the normally open three way valve (67) which maintains pressure while the lift cylinder shaft (19) is retracting and pushing air out of FIG. 7, port (8) through the "T" in the four way valve (66) into port A of the normally open three way valve (67) holding the normally open three way valve (67) closed. Once the lift cylinder shaft (19) is fully retracted, pressure is eliminated in the normally open three way valve (67) allowing the normally open three way valve (67) to return to normal condition (normally open thus allowing air to pass through).

Figure 8:
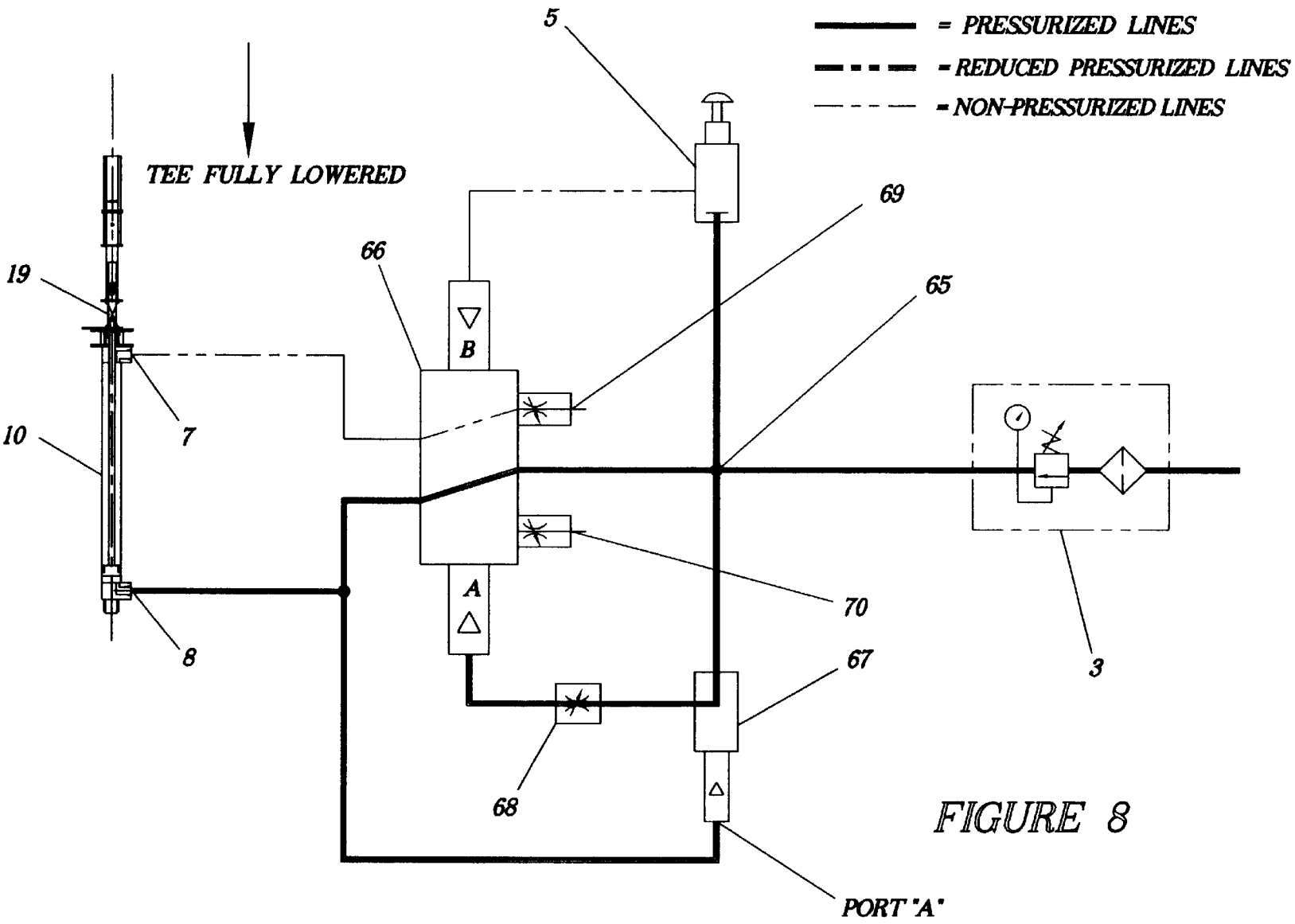
FIG. 8 illustrates air control valve system at mid cycle

The mid cycle air control valve system (6) FIG. 8 begins with air passing through normally open three way valve (67) through the needle valve (68) into pilot operator A of four way valve (66) shifting the four way valve (66) back to its inactivated position causing the lift cylinder shaft (19) to extend.

Operation—FIGS. 1, 2, 6, 7, 8, 9 (continued)

The other three primary elements to the total operation of the air control valve system (6) are the three flow control valves (68, 69, & 70). Two flow control valves (69 & 70) located on four way valve (66) control the upward speed and retracting speed by releasing the air from the four way valve (66).

The third flow control valve (68) (FIGS. 6, 7, & 8) located between the four way valve (66) and normally open three way valve (67) controls the dwell or the time the rubber tee (18) is at the bottom of its stroke (mid-cycle). This enables the ball to drop onto the rubber tee (18) from the gravity ball supply tube (4).

FIG. 9 rod seal/mounting nut (17) is especially designed to prevent moisture from entering the lift cylinder (10) by using a non spring loaded seal. This seal wipes all liquid from the lift cylinder shaft (19) shaft thereby preventing moisture from penetrating around the guide bushing located at the end of the lift cylinder (10) where the lift cylinder shaft (19) slides in and out.

I claim:

1. A golf ball teeing-up device comprising a horizontal base plate with a artificial turf attached to top surface of said base plate, a ball hopper attached to said base plate on top of said artificial turf positioned near an end of said artificial turf and said base plate to prevent a club head from coming in contact with said ball hopper when driving golf balls from either left handed or right handed position once the operator touches a cycle start button attached beneath said base plate located between said ball hopper and a rubber tee protruding just above said artificial turf in such position to eliminate need for operator to move their feet, take hands off the club, or bend over when cycling said golf ball teeing up device from tee-up position to tee-up position, once said cycle start button is touched said rubber tee drops down perpendicular to said base plate below a gravity ball supply tube which is slightly inclined allowing balls placed in said hopper into said slightly inclined gravity ball supply tube to roll onto said rubber tee allowing one ball at a time to be placed on top of said rubber tee during each cycle, said rubber tee is adjustable for tee off lie height or fairway lie height by pushing down and turning one quarter turn on a spring loaded bayonet adjustable sleeve between cycles locking said sleeve into position, said spring loaded bayonet adjustable sleeve having pins pushed through in opposite directions protruding outward so as to locate into four holes positioned in opposite directions on said rubber tee thus locking said rubber tee onto said spring loaded bayonet adjustable sleeve until worn out, said rubber tee and said spring loaded bayonet adjustable sleeve is prevented from being destroyed when a club head is thrust against said rubber tee by a thrust disc which rides vertically with said rubber tee and said spring loaded bayonet adjustable sleeve during a lift stroke, said thrust disc having a anti-rotation key protruding horizontally out into a vertical slot in a cylinder tube which prevents a lift cylinder shaft from rotating whenever said rubber tee adjustments are made, a lift cylinder being resistant to moisture having a rod seal/mounting nut mounted on top of said lift cylinder concentric to said lift cylinder shaft, said rod seal/mounting nut also holding in place a locating disc which holds said lift cylinder concentric to said cylinder tube, said lift cylinder is held at the bottom of said cylinder tube by a anchoring nut which keeps said lift cylinder in position both concentrically and against the bottom of said cylinder tube, said golf ball teeing-up device having an air supply connected to said lift cylinder.

2. The golf ball teeing-up device of claim 1 wherein a cycle start button is disposed between said ball hopper and said rubber tee whereby a left handed or right handed golfer can touch the cycle start button with a sole of a club preventing a golfer from having to move their feet, bend over, or take hands from the club.

3. The golf ball teeing-up device of claim 1 wherein a air control valve system activating an air cylinder through valves contains the key component to said air control valve system which is a normally open three way valve which maintains pressure while the lift cylinder is retracting and pushing air out of the bottom of the lift cylinder through a tee in a four way valve of said air control valve system and into one end of the normally open three way valve holding the normally open three way valve actuated and when the lift cylinder is fully retracted the pressure is eliminated in the normally open three way valve to return to normal condition allowing air to pass.

4. The golf ball teeing-up device of claim 3 and further including said air control valve system at mid-cycle where air passes through a normally open three way valve and through a needle valve into a four way valve shifting the four way valve back to its inactivated position leaving the said lift cylinder shaft extended.

5. The golf ball teeing-up device of claim 4 and further including three flow control valves which are located on the said four way valve controlling the upward speed and retracting speed by releasing air from the said four way valve and the third flow control valve located between the said four way valve and the said normally open three way valve on the said needle valve controlling the dwell or the time the rubber tee is at the bottom of its stroke.

6. The golf ball teeing-up device of claim 1 wherein the adjustable tee makes it possible to adjust the height in two positions predetermined by the bayonet style slot cut into a tube placed over a solid post so that a pin protruding from said solid post rides in the said bayonet style slot giving it the ability to be positioned either at the bottom of said bayonet slot for the tee off lie on the highest point to the other peak of the bayonet style slot being the lowest point for fairway lie controlled by a spring placed between the bottom of said tube and a anti-rotation key allowing for a simple push turn and release mechanism thus maintaining tension at each position preventing a premature adjustment.

7. The golf ball teeing-up device of claim 1 wherein side load is eliminated by a thrust disc whenever said rubber tee is hit with a club head thus preventing fatigue to the said lift cylinder and said lift cylinder shaft by thrusting against the inner walls of the said cylinder tube.

8. The golf ball teeing-up device of claim 7 further includes a locating disc mounted on the end of said lift cylinder concentric to the center of said lift cylinder tube and the inner walls of said lift cylinder tube holding the top end of said lift cylinder in position both vertically and horizontally allowing the ball to travel from tee up position to tee up position without rubbing the inner walls of said cylinder tube when said lift cylinder is attached to bottom of said cylinder tube and anchored with an anchoring nut.

9. The golf ball teeing-up device of claim 1 wherein the rod seal/mounting nut is designed to prevent moisture from entering said lift cylinder around the cylinder shaft sleeve by wiping said cylinder shaft each time it moves downward from the upward position and is sealed with sealant at the threads to prevent moisture from seeping in thus giving the golf ball teeing device ability to operate in water.

* * * * *